US006901987B1

(12) United States Patent
Graham

(10) Patent No.: US 6,901,987 B1
(45) Date of Patent: Jun. 7, 2005

(54) FURLED DECORATIVE COVERING APPARATUS AND METHOD

(76) Inventor: Jonathan W. Graham, 1020 SE. 11th St., Fort Lauderdale, FL (US) 33316

( * ) Notice: Subject to any disclaimer, the term of this patent is extended or adjusted under 35 U.S.C. 154(b) by 0 days.

(21) Appl. No.: 10/672,818

(22) Filed: Sep. 26, 2003

(51) Int. Cl.[7] ..... E06B 9/08
(52) U.S. Cl. ..... 160/121.1; 160/268.1; 160/85; 160/31
(58) Field of Search ..... 160/85, 86, 120, 160/121.1, 98, 310, 311, 25, 31, 127, 239, 160/241, 268.1, 405

(56) References Cited

U.S. PATENT DOCUMENTS 2,349,368 A * 5/1944 Meyers ..... 126/285 R
3,308,872 A * 3/1967 Smith ..... 160/120
4,079,772 A * 3/1978 Klaenhammer et al. . 160/268.1
4,329,716 A 5/1982 Porco
4,419,982 A * 12/1983 Eckels ..... 126/625
4,766,941 A * 8/1988 Sloop et al. ..... 160/241
5,123,474 A * 6/1992 Smith ..... 160/310
5,138,462 A 8/1992 Skovgaard
5,264,765 A 11/1993 Pecorino
5,467,266 A * 11/1995 Jacobs et al. ..... 700/56
5,566,736 A * 10/1996 Crider et al. ..... 160/121.1
5,568,831 A * 10/1996 Blackwell ..... 160/98
5,720,137 A * 2/1998 Rodriquez ..... 52/202
6,070,642 A * 6/2000 Douglas et al. ..... 160/310

* cited by examiner

*Primary Examiner*—David Purol
(74) *Attorney, Agent, or Firm*—Dan Brown Law Office; Dan R. Brown

(57) ABSTRACT

A decorative covering apparatus and method. A frame with an opening formed into it has a first roller that rotates about an axis. A flexible cover is arranged to loop between a first edge that is fixed relative to the frame and a second edge that is affixed to the first roller. A second roller is disposed at the apex of the loop in the flexible cover, and, a motor is coupled to rotate the first roller in a first direction and in a second direction. This action causes a furling and unfurling the flexible cover to reveal and conceal the opening. It also causes the second roller to traverse the opening in the frame. A decorative frame is attached to the frame. The decorative cover is adapted to conceal and reveal a wall mounted object located behind the opening in the frame, such as a flat panel television set. Control is implemented with a remote control receiver, which receives a control signal that is coupled to control the motor to rotate in an up and down direction. The flexible cover has a decorative image disposed on a first side that is aligned to be visible when the flexible cover is unfurled to conceal the opening.

29 Claims, 6 Drawing Sheets

FURLED DECORATIVE COVERING APPARATUS AND METHOD

BACKGROUND OF THE INVENTION

1. Field of the Invention

The present invention relates to decorative coverings. More specifically, the present invention relates to decorative coverings that are furled and unfurled within a frame structure to reveal and conceal another object, such as a television set.

2. Description of the Related Art

Some individuals invest a significant amount of effort and investment in decorating their home in a particular style, including furniture, artwork, wall coverings, fixtures, and so forth. Some businesses and retail stores similarly invest in a particular decor that meets the needs or desires of their owners and customers. However, homes and businesses employ a wide variety of devices, fixtures, and structures that may be inconsistent with a desired decor or style. Examples of such items include electrical control panels, television sets, wall safes, medicine cabinets, valuable items of artwork, access openings, mechanical systems, structural components and so forth. When such items interfere with a desired decor, then it has been necessary to disguise or conceal them in some fashion, or endure an item that is unappealing as compared to the general decor of a room or space. However, concealment can be problematic in that it can interfere with access when needed. It can also be cumbersome to reveal and conceal such items from time to time.

There are certain coverings known in the art. A hinged painting in front of a wall safe is familiar. However such an approach is only useful when access is necessary for a short period of time, because the painting is unappealing when left in the 'open' position. It is also known in the art to retract or hide the objectionable item when not in use. An example of this approach is a projection screen that retracts into a ceiling fixture, and is only extended into view when the user desires to project images onto the screen. The retractable screen approach has been applied to concealment as well. U.S. Pat. No. 5,264,765 to Pecorino et al. teaches a cover unit for a flat panel video display, for deploying a flexible cover over the display. Essentially, this is similar to a window shade that is lowered and raised in front of a television screen. While the Pecorino et al. approach is effective at covering a television, it lacks a degree of elegance that is often times desired in a refined decor environment. Thus, there is a need in the art for an apparatus and method for providing a convenient decorative covering over objectionable items, and that is consistent with a desired decor in a room.

SUMMARY OF THE INVENTION

The need in the art is addressed by the apparatus and methods of the present invention. A decorative covering is taught that includes a frame with an opening formed into it. A first roller is coupled to the frame and rotates about an axis. A flexible cover is arranged to loop between a first edge that is fixed relative to the frame and a second edge that is affixed to the first roller. A second roller is disposed at the apex of the loop in the flexible cover, and, a motor is coupled to rotate the first roller in a first direction and in a second direction. This causes a furling and unfurling the flexible cover to reveal and conceal the opening. It also causes the second roller to traverse the opening in a direction substantially perpendicular to the axis of the first roller.

In a particular embodiment to the foregoing invention, the decorative cover further includes a decorative frame attached to the frame, where the decorative frame has a window opening in it that is smaller than the opening in the frame. In a refinement to the invention, the decorative frame is removably attached to the frame. In another embodiment, the decorative cover is adapted to conceal and reveal a wall mounted object located behind the opening in the frame. In this case, a wall mounted structure is coupled to support the frame in a position adjacent to the wall. To further refine the installation, a decorative side panel, disposed about the periphery of the frame, may be added. The wall mount structure may adjustable about three orthogonal axes, thereby enabling alignment of the opening in the frame with the wall mounted object. In a particular application, the wall mounted object is a flat panel television.

A particular embodiment of the invention utilizes a motor that is disposed within the first roller. Control can be implemented with a remote control receiver, operable to receive a control signal, that is coupled to control the motor to rotate in the first direction and the second direction. The remote control signal can be either a radio signal or an infrared signal. To enhance the appearance of the decorative cover, the flexible cover has a decorative image disposed on a first side that is aligned to be visible when the flexible cover is unfurled to conceal the opening. The flexible cover may be canvas or a synthetic canvas blend and the decorative image is a Giclee print resembling an oil painting.

In a refinement to the present invention, a guide channel disposed along at least a first side of the opening is added. It is positioned to constrain the movement of the second roller along the direction of traverse. A second guide channel may be added to the opposite side. In another refinement, a magnetic strip is fixed relative to the frame and aligned along a side of the opening that is parallel to the direction of traverse of the second roller. And, the flexible cover has a ferrite coating applied along an edge oriented parallel to the direction of traverse of the second roller such that the ferrite coating magnetically couples to the magnetic strip as the flexible cover unfurls to conceal the opening. Another magnetic strip and ferrite coating can be added to the opposite side opening.

In a particular embodiment of the present invention, a decorative covering for a wall mounted flat screen television is taught. The decorative covering includes a frame with an opening and a decorative frame removably attached to the frame. The decorative frame has a smaller window opening than the opening in the frame. A wall mount structure is coupled to support the frame adjacent to the wall, and the wall mount structure is adjustable about three orthogonal axes. These adjustments enable alignment of the window opening in the decorative frame with the television. A decorative side panel is disposed about the periphery of the frame between the decorative frame and the wall. A first roller is coupled to the frame, and rotates about an axis. A flexible canvas cover, having a decorative image disposed thereon, is arranged to loop between a first edge fixed relative to the frame and a second edge affixed to the first roller. A second roller is disposed at the apex of the loop in the flexible canvas cover. A motor is disposed within the first roller and is coupled to rotate the first roller in a first direction and a second direction, thereby furling and unfurling the flexible cover to reveal and conceal the opening. This action also causes the second roller to traverse the opening in a direction substantially perpendicular to the axis. A guide channel is disposed along at least a first side of the opening, and is positioned to constrain the movement of the second roller along the direction of traverse. A remote control receiver operates to receive a radio control signal, and is coupled to control the motor to rotate in the first direction and the second direction.

The present invention also teaches a method of revealing and concealing an opening in a frame with a flexible cover. The method includes the steps of rotating a first roller about an axis in a first direction and a second direction to furl and unfurl the flexible cover, which is arranged to loop between a first edge fixed relative to the frame and a second edge coupled to the roller, and, traversing a second roller across the opening in a direction substantially perpendicular to the axis by disposing the second roller at the apex of the loop in the flexible cover.

In a specific embodiment, the method includes the further step of attaching a decorative frame to the frame, where the decorative frame has a smaller window opening than the opening in the frame. The decorative frame may be removably attached to the frame. In another specific embodiment, the method includes the further steps of concealing and revealing a wall mounted objected located behind the opening by mounting the frame to the wall using a wall mount structure. It may also include the step of disposing a decorative side panel about the periphery of the frame. In a refinement, the step of adjusting the position of the frame about three orthogonal axes to align the frame with the wall mounted object is added. The wall mounted object may be a flat panel television.

In a specific embodiment of the present invention, the method includes the step of driving the first roller with a motor. The steps of receiving a remote control signal by a remote control receiver and driving a motor to rotate the first roller according to the received control signal my be added. The remote control signal may be a radio signal or an infrared signal. In a refinement of the method, the step of disposing a decorative image on a first side of the decorative cover, aligned to be visible when the flexible cover is unfurled to conceal the opening is added. In a particular refinement, the flexible cover is canvas or synthetic canvas blend and the decorative image is a Giclee print resembling an oil painting.

In another particular embodiment the method includes the further steps of constraining the movement of the second roller along the traversing directions by disposing a guide channel along at least a first side of the opening. In another refinement, the method includes the steps of fixing a magnetic strip relative to the frame that is aligned along a side of the opening that is parallel to the traversing direction of the second roller. Then, applying a ferrite coating to the flexible cover along an edge oriented parallel to the traversing direction of the second roller, and, magnetically coupling the ferrite coating to the magnetic strip as the flexible covering unfurls to conceal the opening.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
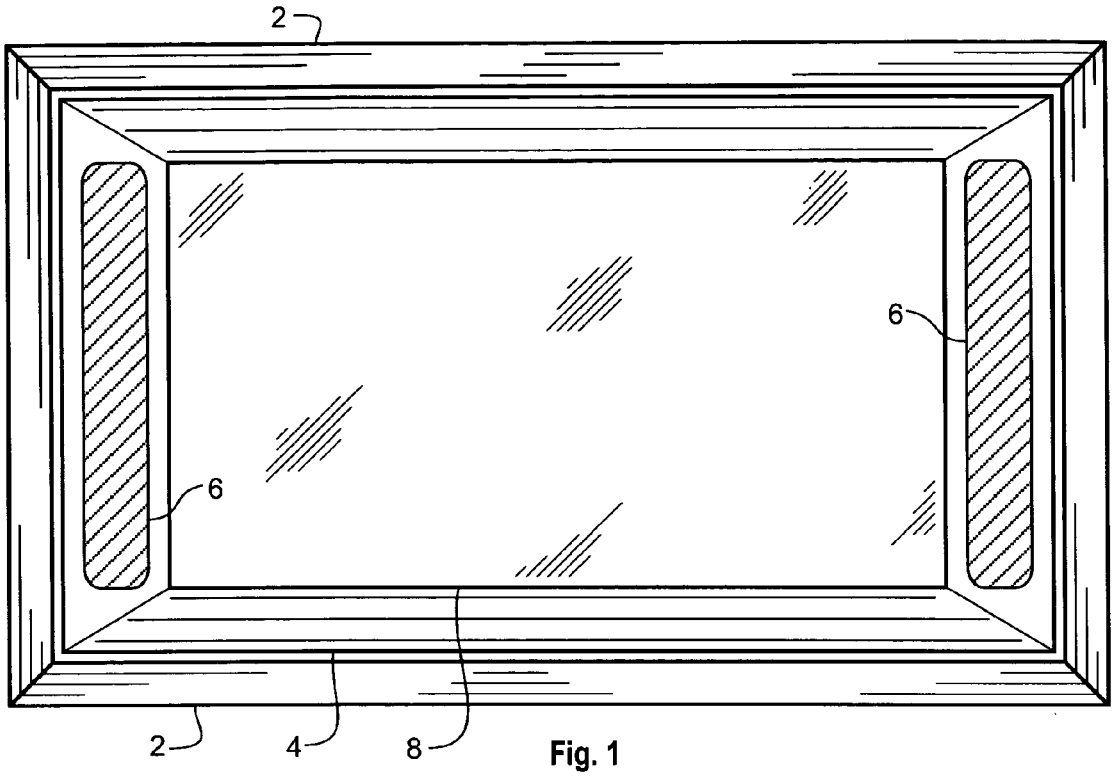
FIG. 1 is a front view drawing of a flat-screen television exposed within a decorative covering apparatus according to an illustrative embodiment of the present invention.

Reference is directed for FIG. 1, which is a front view drawing of a flat-screen television revealed within a decorative covering apparatus according to an illustrative embodiment of the present invention. In FIG. 1, the television 4 is a plasma screen technology flat panel television with loudspeakers 6 positioned on the front of the television 4. The apparatus of the illustrative embodiment is configured to reveal the television 4 within and opening therein. The opening is configured to be slightly larger than the exterior dimensions of the television 4. Given the direct frontal view in FIG. 1 and the revealed configuration, the only visible portion of the illustrative embodiment apparatus is a decorative frame 2. Note that the television 4 is not a part of the present invention, but is rather an object that the present invention can reveal and conceal. When concealed, the apparatus of the present invention serves to present a more attractive, uniform, secretive or desirable appearance, as compared to the object that is covered. In FIG. 1 the object is a television set 4. The object could be any device, object, fixture, or other thing that a user may desire to conceal and reveal from time to time for convenience, esthetic, security, or other reasons. The decorative frame 2 in FIG. 1 is a mitered-joint picture frame, which may employ any style and finish desired by the user of the device. For example, a simple contemporary picture frame may be chosen or an elaborate gilded classic picture frame. The choices of style are limitless.

Figure 2:
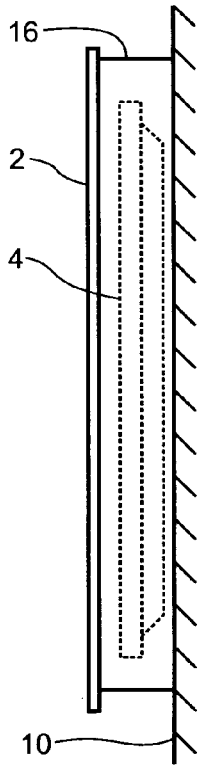
FIG. 2 is a side view drawing of a decorative covering apparatus according to an illustrative embodiment of the present invention.

Reference is directed to FIG. 2, which is a side view drawing of the decorative covering apparatus according to the illustrative embodiment of FIG. 1. In FIG. 2, the decorative frame 2 is seen from the side, with the television set 4 shown in phantom because it is behind a decorative side panel 16 of the apparatus. Both the apparatus of the illustrative embodiment of present invention and the television set are mounted to a vertical wall 10. The decorative side panel 16 can be covered or painted to suit any particular decor, and can even be omitted altogether if the configuration is not visible from the side view, or if the apparatus is flush mounted to the wall 10. In the flush mount configuration, the television set is set into a recess in the wall, as well as certain functional components of the present invention, which will be more fully discussed hereinafter. In the flush mounted configuration, the only extension from the wall 10 may be the decorative frame 2.

Figure 3:
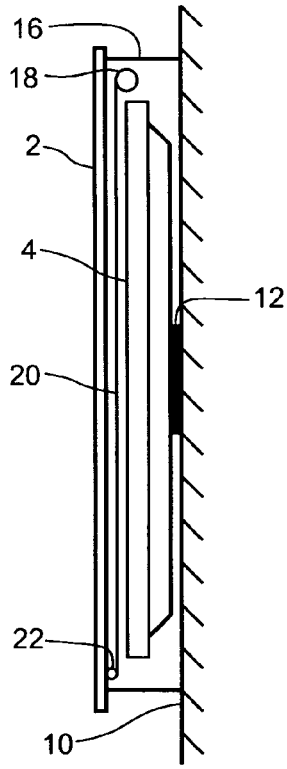
FIG. 3 is a sectional side view of a decorative covering apparatus according to an illustrative embodiment of the present invention.

Reference is directed to FIG. 3, which is a sectional side view of the decorative covering apparatus according to the illustrative embodiment of FIG. 1. The view in FIG. 3 is a side-looking section that illustrates some of the functional components and aspects of the illustrative embodiment apparatus. The television set 4 is shown mounted to the wall 10 with a conventional flat screen television-mounting channel 12, as are known to those skilled in the art. The decorative frame 2 of the illustrative embodiment is supported in front of the television set 4. Disposed between the front of the television set 4 and behind the decorative frame 2 is a flexible cover 20 that can be unfurled from a first roller 18 in front of the television set 4, thereby concealing the television set 4 from view. A second roller 22 serves to guide and create tension upon the surface of the flexible cover 20, thereby holding it flat and adjacent to the decorative frame 2. Note that FIG. 3 illustrates the flexible cover in the unfurled position. The first roller 18 can be rotated to furl the flexible cover 20 thereupon. As the first roller 18 is rotated and the flexible cover 20 furls thereupon, the second roller 22, which is supported at the apex of a loop formed in the flexible cover 20, traverses the opening in the decorative frame 2. In the fully furled position, the second roller is positioned near the top of the decorative frame 2, and the front of the television set 4 is revealed in the opening in the decorative frame 2.

Figure 4:
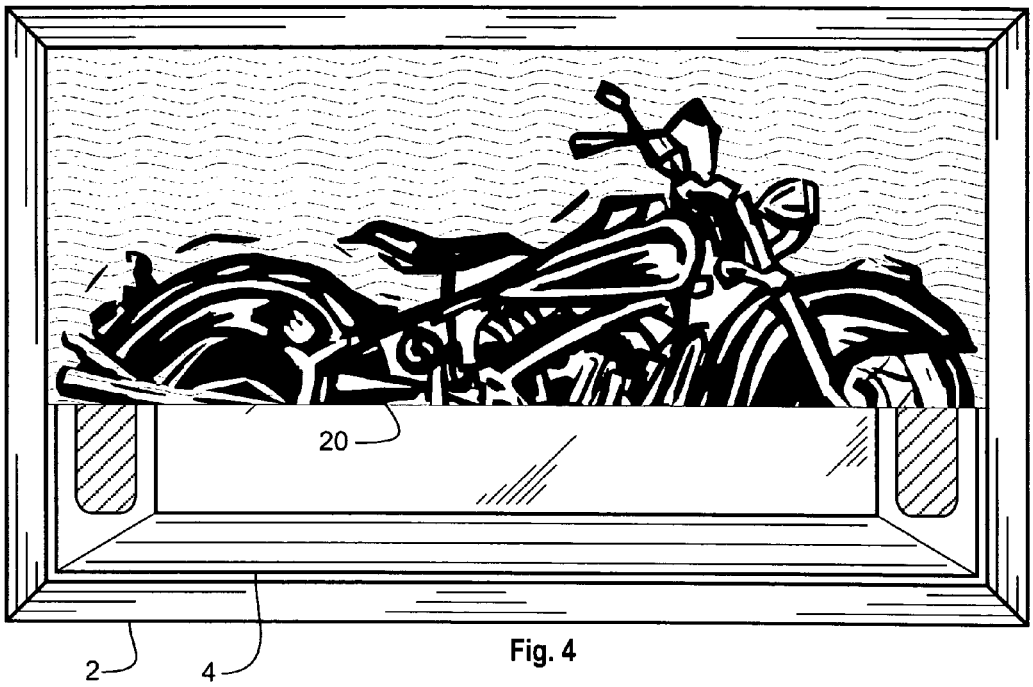
FIG. 4 is a front view drawing of a decorative covering, during the process of unfurling the artwork cover, according to an illustrative embodiment of the present invention.

Reference is directed to FIG. 4, which is a front view drawing of a decorative covering apparatus, during the process of unfurling (or furling) the flexible cover, according to the illustrative embodiment of FIG. 1. In FIG. 4, the decorative frame 2 is visible. So too is a portion of the television set 4 that is positioned behind the opening in the decorative frame 2. Note that the flexible cover 20 is unfurled to approximately two-thirds of the opening's vertical dimension. An advantage of the present invention is apparent from this drawing FIG. 4. As the flexible cover is unfurled, the top edge remains fixed relative to the upper inside portion of the frame. Therefore, the visible portion of the artwork imprinted on the surface of the flexible cover remains fixed in position relative to the frame. This is different from the window shade style of covering, where the image appears to be pulled down over the object to be covered. The present invention presents a more elegant appearance. However, this design also reduces edge wear on the flexible cover, allows for the flexible cover to held more closely to the decorative frame, and allows the flexible cover to be held in place by magnetic forces that are not feasible in the window shade approach to covering.

Figure 5:
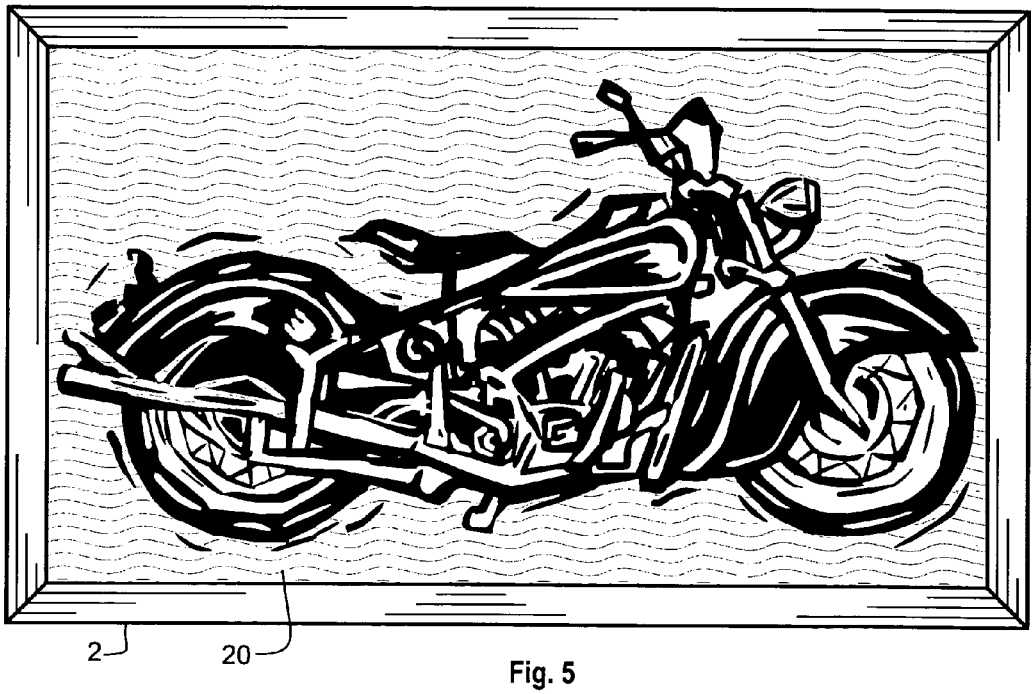
FIG. 5 is a front view drawing of a decorative covering apparatus with the artwork cover unfurled according to an illustrative embodiment of the present invention.

Reference is directed to FIG. 5, which is a front view drawing of a decorative covering apparatus with the flexible cover 20 fully unfurled, according to the illustrative embodiment of FIG. 1. In FIG. 5, only the decorative frame 2 and flexible cover 20 are visible in the direct frontal view. Thus, the apparatus of the illustrative embodiment has fully concealed the television set, and gives the appearance of a framed item of artwork. Users of the present invention may select any desirable or suitable image or surface treatment for the flexible cover that fits the desired decor or function. FIG. 5 shows an abstracted image of a motorcycle, however any image can be used. In one illustrative embodiment, the flexible cover 20 is fabricated from canvas or a synthetic canvas blend and a replica of a painting is imprinted thereupon. A reproduction technique known to those skilled in the art as a Giclee print is used to create very pleasing replica of a classic painting. When used in combination with a suitable style decorative frame, the unfurled and concealed orientation of the illustrative embodiment can closely resembles an item of fine art. Yet, when the flexible cover is furled, the television set, or other object, is fully revealed and available for conventional viewing or access. The fixed position orientation of the artwork provides a pleasing transition from the furled to unfurled positions.

Figure 6:
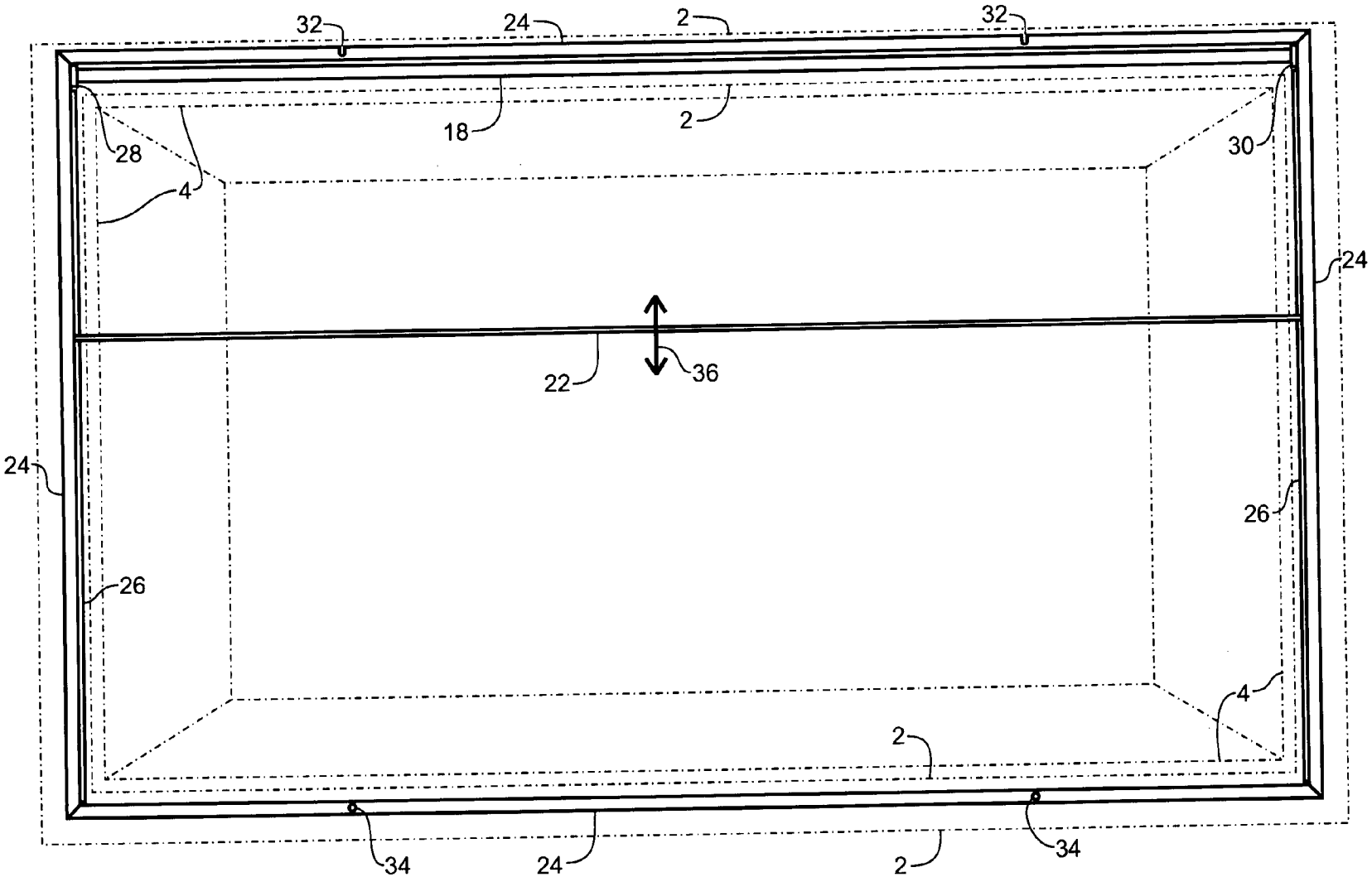
FIG. 6 is a front view drawing of the mounting frame and roller mechanism of a decorative covering apparatus according to an illustrative embodiment of the present invention.

Reference is directed to FIG. 6, which is a front view drawing of the mounting frame and roller mechanism of the decorative covering apparatus according to the illustrative embodiment in FIG. 1. FIG. 6 illustrates a portion of the structural and functional components of the illustrative embodiment. For orientation purposes, the position of the decorative frame 2 and television set 4 are shown in phantom. The decorative frame 2 is supported by a structural frame 24, (also referred to as the "frame") which is formed from steel or aluminum channel-section material in the illustrative embodiment. The decorative frame is supported by two upper pins (not shown) that engage two slots 32 formed in the top piece of channel forming the structural frame 24. Two holes 34 in the bottom side of the structural frame 24 each have an adjustable female tension ball latch fitted thereto, which engage two male catch pins attached to the decorative frame. This arrangement allows the structural frame and roller mechanisms to be installed around the television set, then aligned, prior to the attachment of the decorative frame.

A first roller 18 is positioned between the sides of the structural frame 24 near the top of the opening formed by the frame 24. A drive motor mount 28 and rotatable mount 30 rotatably support the first roller about a horizontal axis or rotation. The drive motor mount 28 and the rotatable mount 30 at the opposite end of the first roller 18 are mounted to the metal frame 24 on floating acoustically and vibration dampened flexible isolation mounts (not shown). Isolation mounts are known to those skilled in the art, and the mounts utilized in the illustrative embodiment are available from Soundown Products in Fort Lauderdale, Fla. Further, constrictive foam, lead, and foil material may be adhered to the metal frame 24 at these connection points for greater sound and vibration damping. The flexible cover (not shown) has its top edge fixed to the first roller 18. A motor (not shown) rotates the first roller 18 in either a first direction or second direction, which are clockwise and counter-clockwise to furl and unfurl the flexible cover from and to the second roller 18. The flexible cover (not shown) hangs in a loop, which is more fully described hereinafter. The second roller hangs at the bottom of that loop, and is thereby supported by the flexible cover. In FIG. 6, the second roller is illustrated at about the on-third position from the top of the opening in the structural frame 24. As the flexible cover is furled and unfurled, the second roller 22 moves along an axis that is substantially perpendicular to the axis of rotation of the first roller 18. Thus, the second roller traverses the opening in the structural frame 24, as well as the opening in the decorative frame 2 in a direction indicated by arrow 36 in FIG. 6. The front-to-back position of the second roller 18 is constrained between the back of the decorative frame 2 and a pair of guide channels 26. Further details of this arrangement will become evident in the discussions of other figures herein.

Figure 7:
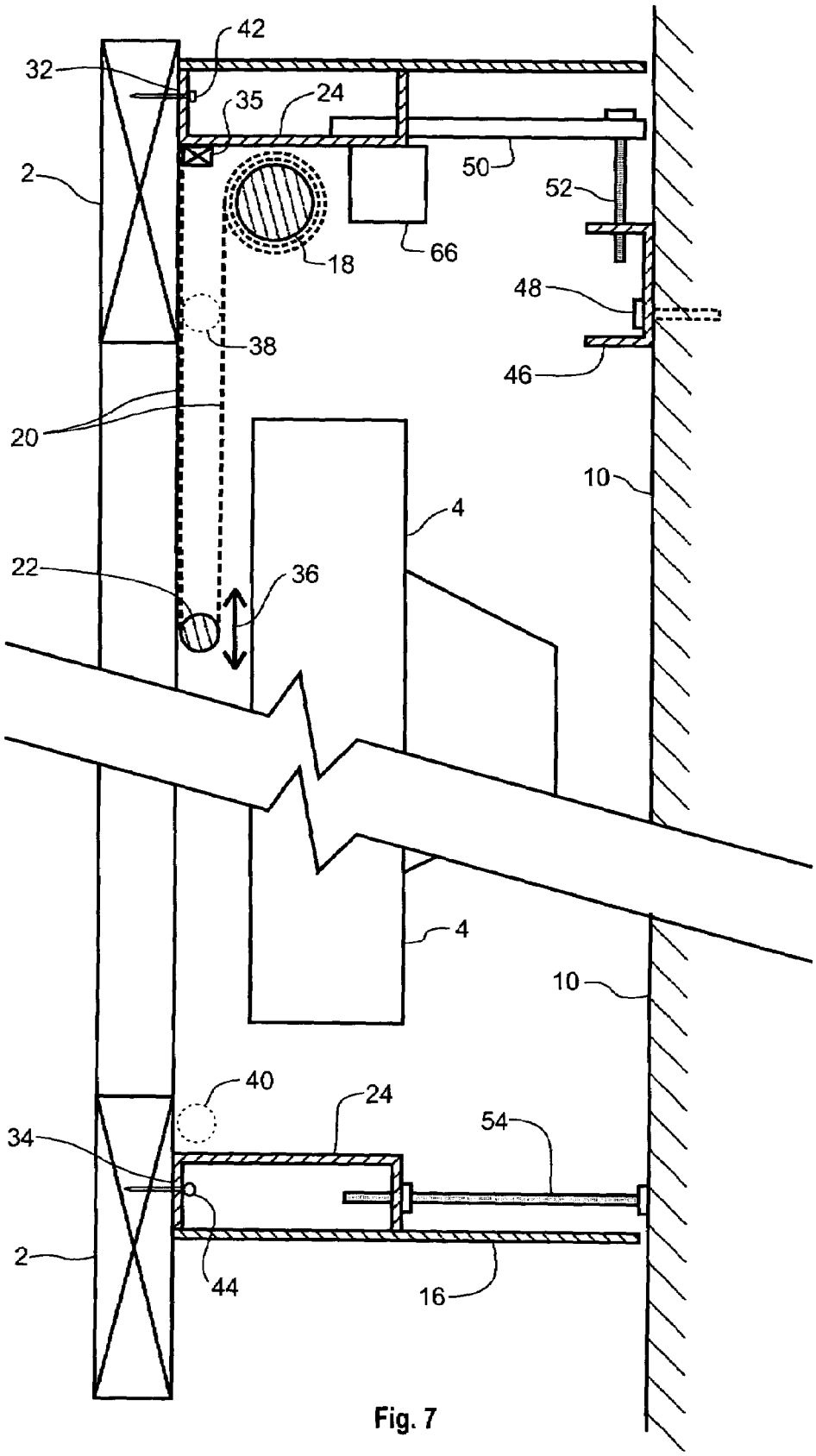
FIG. 7 is a section view drawing of a decorative covering apparatus according to an illustrative embodiment of the present invention.

Reference is directed to FIG. 7, which is a section view drawing of a decorative covering apparatus according to the illustrative embodiment in FIG. 1. FIG. 7 is a side-looking section view taken between the sides of the structural frame 24. The wall 10 on which the television set 4 and the apparatus of the present invention are mounted is shown. The channel-section structural frame 24 is visible in section along the top and bottom of the apparatus. The decorative frame 2 is shown. The decorative side panels 16 are also visible. Note that the opening height of the decorative frame is smaller than the opening height of the structural frame 24. This difference provides space for concealing the motor and roller mechanisms. One of the two upper mounting pins 42 is visible as it is engaged in the slot 32 in the structural frame 24. Similarly, the lower male catches 44 are engaged in the bottom female tension ball latches 34 in the lower frame 24 channel. Mounting pins, slots, and tension ball latches are known to those skilled in the art. The first roller 18 has the flexible cover 20 partly furled thereon. The flexible cover drapes into a loop with a first edge attached to the first roller 18 and the second edge attached to the frame channel 24. An attachment block 35 is used to secure the second edge of the flexible cover to the frame channel 24. The second roller 22 hangs at the apex of the loop in the flexible cover under the force of gravity, and serves to hold the flexible cover in tension. Other forces than the force of gravity can be employed. In the illustrative embodiment, the second roller is a one-half inch diameter stainless steel rod having a length approximately one inch longer than the opening in the decorative frame. A remote control radio receiver 66 is attached to the channel of frame 24 at a convenient and concealed location. An infrared receiver can also be utilized, however the line of sight characteristics of the infrared signal must be addressed, as are known to those skilled in the art.

In operation, a motor (not shown in FIG. 7) drives the first roller 18 in one of two directions. When driven in the counter-clockwise direction, the flexible cover 20 is unfurled from the first roller 18, which causes the second roller 22 to traverse the opening in the frames 2, 24, in a downward direction. The flexible cover 20 is thus unfurled to conceal the opening in the frames 2, 24, as well as the television set 4. Note the position of the second roller 18 is shown in phantom 40 in the fully unfurled position. When the motor drives the first roller in the clockwise direction, the flexible cover 20 is furled onto the first roller 18, which cause the second roller 22 to traverse the openings 2, 24 in an upward direction. When the flexible cover is fully furled onto the first roller 18, the second roller has traversed the openings 2, 24 and is in the position indicated in phantom 38 near the top of the frames 2, 24. This action reveals the openings 2, 24, as well as the television set 4. Note that the fixed end of the flexible cover 20 that is secured to the frame 24 establishes the fixed position of the flexible cover 20, and the graphic image imprinted thereon, with respect to the decorative frame 2.

The installation of the apparatus of the present invention is a matter of significant practical importance. FIG. 7 illustrates certain aspects of the mounting structure that are of significant benefit in this regard. In a typical installation, the television set will have already been mounted and leveled on the wall 10. A goal of the installation of the decorative covering apparatus is to align and level the apparatus with respect to the television set 4. Yet, it is desirable to minimize the number of precision measurements and operations in the installation process. This general goal is achieved by employing adjustment controls in the mounting assembly. The installation begins by attaching a mounting block, or channel, 46 to the wall 10 with threaded fasteners 48. The position of channel 46 is to be roughly centered with the television set and roughly leveled. A support bar 50 is coupled to the structural frame 24 and extends rearward as far as is required for the depth requirement of the installation. The length of bar 50 may be adjustable. A pair of threaded fasteners 52 are arranged to adjust the space between the mounting channel 46 and the support bars 50 at the two fastener 52 locations. This allows the installer to level the structural frame with the television set. The coupling location of the two threaded fasteners 52 is adjustable along the horizontal axis to allow the installer to align the structural frame from side to side with respect to the television set 4. To control the frame 24 to wall 10 space near the bottom of the structural frame 24, a pair of threaded fasteners 54 are provided. Adjustment of these fasteners 54 also controls the tilt of the structural frame 24. The various threaded fasteners can be adjusted to position the frame 24 about three orthogonal axes. Once the installation of the structural frame is complete, leveled, and aligned, the installer hangs the decorative frame 2 on the structural frame 24. This mounting is accomplished by hanging the upper pins 42 in the frame slots 32, and then pressing the lower snap-in pins 34 into the pin receiver holes 34. Attaching the decorative frame as the last operation in the installation process allows the delicate finish of the frame to be protected during the installation process.

Figure 8:
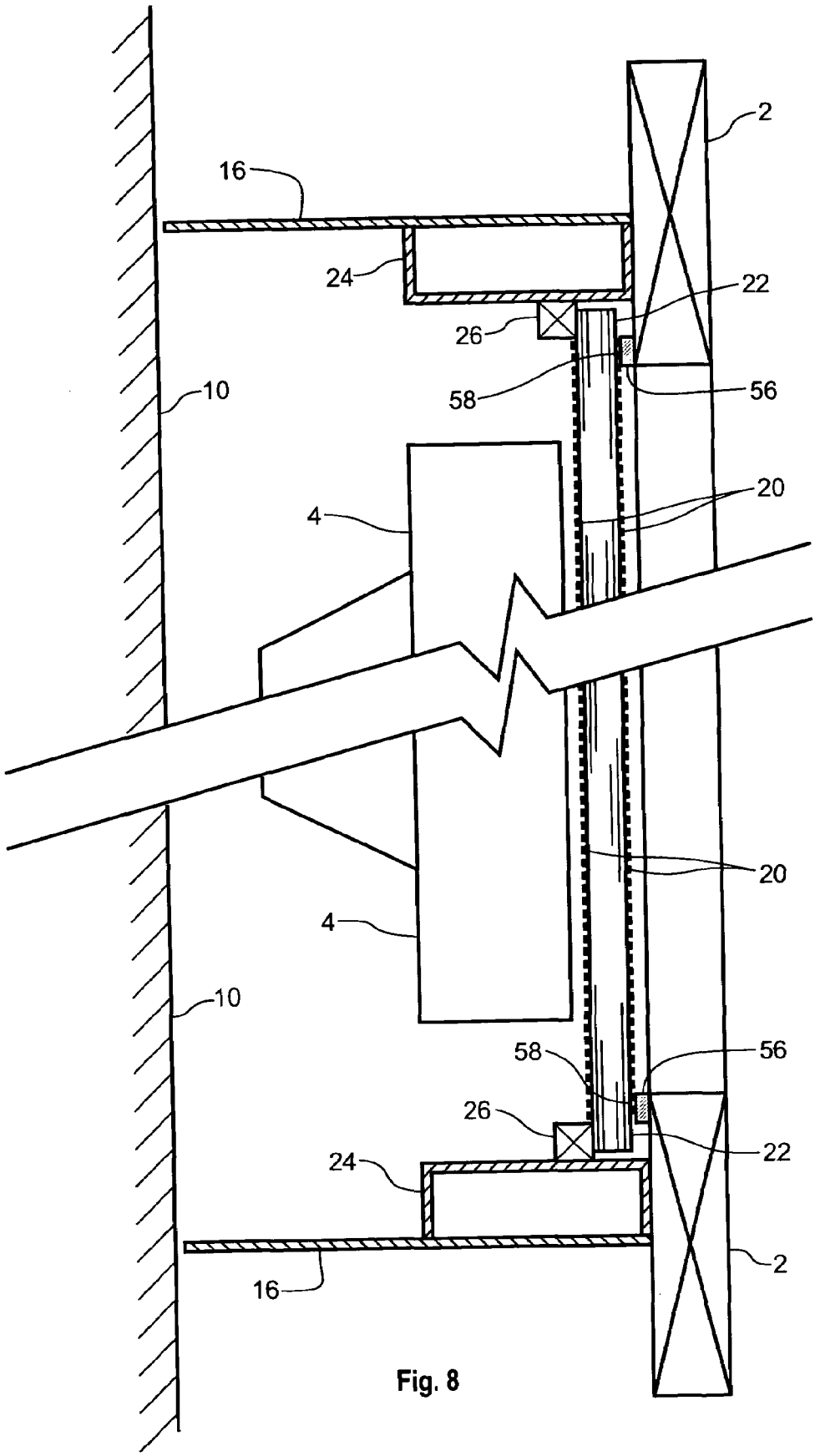
FIG. 8 is a section view drawing of a decorative covering apparatus according to an illustrative embodiment of the present invention.

Reference is directed to FIG. 8, which is a section view drawing of a decorative covering apparatus according to the illustrative embodiment shown in FIG. 1. FIG. 8 is a section view along a horizontal plane, looking down through the structure. The wall 10 on which the television set 4 and structure of the illustrative embodiment are mounted is visible in FIG. 8. The channel sections of the structural frame 24 are visible, as are the decorative side panels 16. The decorative frame 2 is attached to the structural frame 24. The second roller 22 is positioned between the channels of the structural frame 24 and behind the decorative frame 2. The flexible cover 20 is disposed about the second roller 22. A pair of guide channels 26 are positioned to constrain the position of second roller 22 as it traverses the opening in the frames 2, 24. In the illustrative embodiment, a thermoplastic bar is used as the guide channels 26. Delrin is preferred for its good machining and lubricity characteristics. As the second roller 18 traverses the opening, its position is constrained between the guide channel 26 and the back of the decorative frame 2. This constraint holds the flexible cover 20 tight against the back of the decorative frame 2, which aides in maintaining the appearance of a fine art painting when the flexible cover 20 is unfurled to conceal the opening in the frame 2.

FIG. 8 also illustrates another aspect of the present invention. The appearance of the decorative frame 2 and flexible cover 20 while concealing the television is important in may applications. Users desire that the apparatus appear as much like a classic framed painting as possible. Holding the flexible cover 20 tightly against the back to the decorative frame 2 enhances this effect. The present invention achieves this effect, in part, by utilizing a magnetic strip 56 and ferrite coating 58. The magnetic strip 56 is affixed to the back surface of the decorative frame 2. Alternatively, the magnetic strip may be recessed into the back to the decorative frame 2. A ferrite coating 58 is applied to the edges of the flexible cover 20, in alignment with the magnetic strip 56. As the flexible cover 20 is unfurled, the magnetic strip 56 magnetically engages the ferrite coating 58 and holds the flexible cover 20 in close proximity by magnetic force. Magnetic strips and similar materials are known to those skilled in the art. The ferrite coating 58 is available as a paint additive from MagnaMagic, 214 Farm Street, Blackstone, Mass. 01504. Detailed information is available at MagnaMagic's Internet web site; http://www.magnamagic.com.

Figure 9:
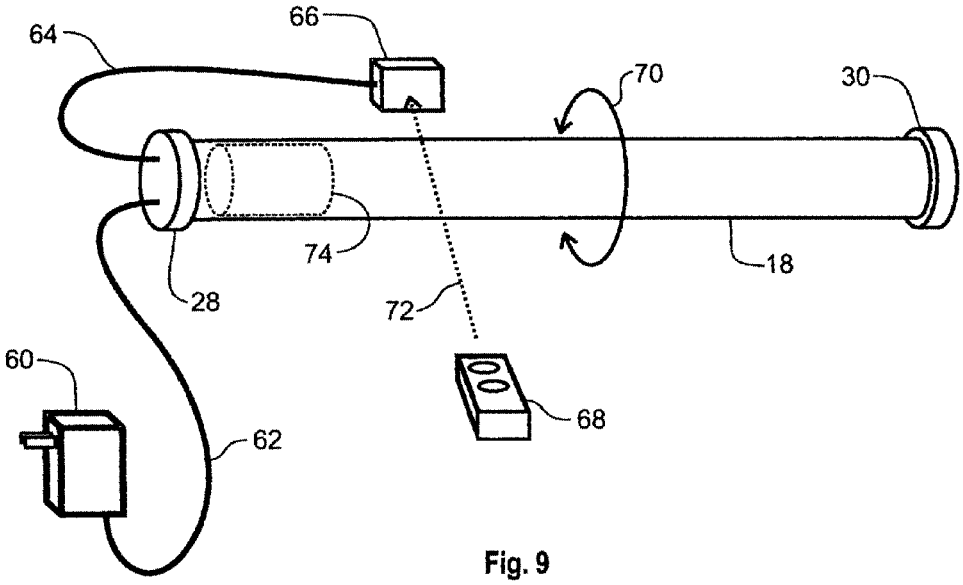
FIG. 9 is a functional block diagram of the electrical circuit arrangement of a decorative covering apparatus according to an illustrative embodiment of the present invention.

Reference is directed to FIG. 9, which is a functional block diagram of the electrical circuit arrangement of a decorative covering apparatus according to an illustrative embodiment of the present invention. The first roller 18 is driven in one to two directions 70 by an integral motor 74. The motor 74 is coupled to a drive motor mount 28 that is fixed to the structural frame (not shown). The opposite end of the second roller 18 is coupled thorough a rotatable mount 30 to the opposite side of the structural frame. Electrical power is provided through a wall-plug transformer and power supply 60 that provides low voltage direct current power through a cable 62 into the drive motor mount 28. A radio remote control signal receiver 66 is coupled by cable 64 through the drive motor mount 28. Integral to the drive motor mount is a pair of limit switches (not shown) that control the limits of the roller rotation, which controls the extent to the furling and unfurling movements. A radio remote control transmitter 68 sends radio signals 72 that include "UP", "DOWN" and "STOP" remote control signals to the remote control receiver 66. In the illustrative embodiment, the motor roller 18, the power supply 60, the remote control receiver 66 and remote control transmitter 68 are Somfy brand products. Somfy brand products are available from Somfy Systems, 47 Commerce Drive, Cranbury, N.J. 08512. The particular Somfy model depends on the size of the roller and flexible cover, however, the Somfy "LS40" and "LT50" ranges of products are useful for 42 inch and 50 inch plasma television set configurations. Information is available from Somfy's Internet web site at http://www.somfysystems.com.

Figure 10:
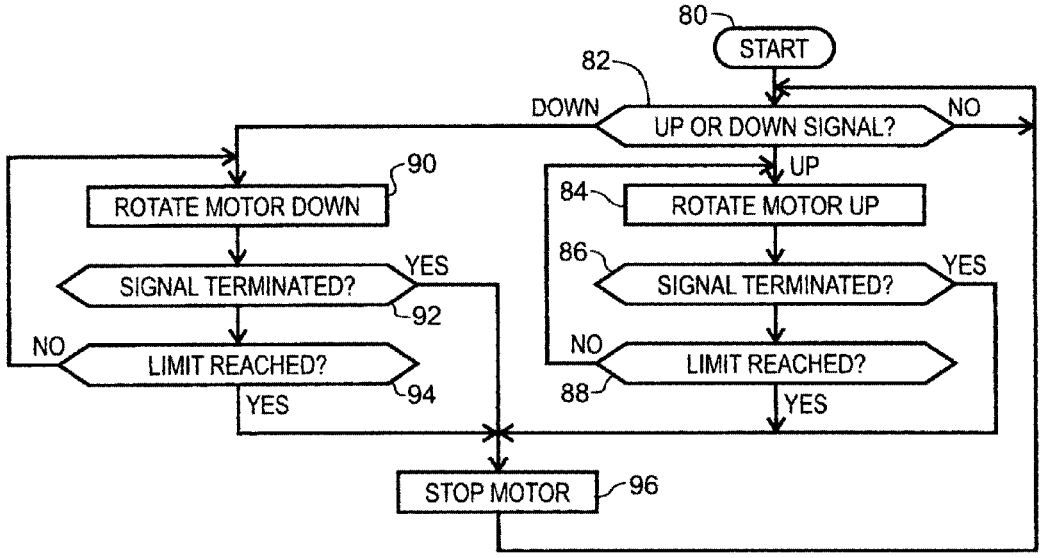
FIG. 10 is a process flow diagram of a decorative covering apparatus according to an illustrative embodiment of the present invention.

Reference is directed to FIG. 10, which is a process flow diagram of a decorative covering apparatus according to an illustrative embodiment of the present invention. The process illustrates the control operation of the remote control and motor drive systems in the illustrative embodiment. The process begins at step 80 and proceeds to step 82 where a test of whether a remote control actuator has been actuated is made. If no actuation has occurred, the test is repeated until such time as an actuation does occur. If an "UP" actuation has been made and an "UP" remote control signal has been received, then flow proceeds to step 84 where the motor is activated to rotate in the up direction. At step 86 a test is made to determine in the "UP" signal has been terminated. Signal termination may occur by releasing the "UP" actuator, or by actuation of a "STOP" actuator on the remote control transmitter. If the signal has been terminated at step 86, then flow proceeds to step 96, where the motor is stopped. On the other hand, at step 86, if the "UP" signal has not been terminated, a test is made at step 88 to determine if the limit of motor travel has been reached. This indicates that the flexible cover is fully furled, and the opening in the frame fully revealed. If the limit has not been reached, flow returns to step 84 as the motor continues to run. On the other hand, at step 88, if the limit has been reached, then flow proceeds to step 96 where the motor is stopped. After the motor is stopped at step 96, flow returns to step 82 to begin anew.

If the test at step 82 indicates the a "DOWN" actuation has been made and a "DOWN" remote control signal has been received, then flow proceeds to step 90 where the motor is activated to rotate in the down direction. At step 92 a test is made to determine in the "DOWN" signal has been terminated. Signal termination may occur by releasing the "DOWN" actuator, or by actuation of a "STOP" actuator on the remote control transmitter. If the signal has been terminated at step 92, then flow proceeds to step 96, where the motor is stopped. On the other hand, at step 92, if the "DOWN" signal has not been terminated, a test is made at step 94 to determine if the limit of motor travel has been reached. This indicates that the flexible cover is fully unfurled, and the opening in the frame fully concealed. If the limit has not been reached, flow returns to step 90 as the motor continues to run. On the other hand, at step 94, if the limit has been reached, then flow proceeds to step 96 where the motor is stopped. After the motor is stopped at step 96, flow returns to step 82 to begin anew.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An apparatus, comprising:

a frame with an opening;

a decorative frame attached to said frame, said decorative frame having a smaller window opening than said opening in said frame;

a first roller coupled to said frame, and rotatable about an axis;

a flexible cover arranged to loop between a first edge fixed relative to said frame and a second edge affixed to said first roller;

a second roller disposed at the apex of the loop in said flexible cover, and a motor coupled to rotate said first roller in a first direction and a second direction, thereby furling and unfurling said flexible cover to reveal and conceal said opening, and cause said second roller to traverse said opening in a direction substantially perpendicular to said axis.

2. The apparatus of claim 1 wherein said decorative frame is removably attached to said frame.

3. The apparatus of claim 1 wherein the apparatus is adapted to conceal and reveal a wall mounted object located behind said opening, said apparatus further comprising:

a wall mount structure coupled to support said frame adjacent to the wall.

4. The apparatus of claim 3 further comprising a decorative side panel disposed about the periphery of said frame.

5. The apparatus of claim 3 wherein said wall mount structure is adjustable about a three orthogonal axes, thereby enabling alignment of said opening in said frame with the wall mounted object.

6. The apparatus of claim 5 wherein the wall mounted object is a flat panel television.

7. The apparatus of claim 1 wherein said motor is disposed within said first roller.

8. The apparatus of claim 1 further comprising a remote control receiver operable to receive a control signal, and coupled to control said motor to rotate in said first direction and said second direction.

9. The apparatus of claim 8 wherein said remote control signal is a radio signal.

10. The apparatus of claim 8 wherein said remote control signal is an infrared signal.

11. The apparatus of claim 1 wherein said flexible cover has a decorative image disposed on a first side and aligned to be visible when said flexible cover is unfurled to conceal said opening.

12. The apparatus of claim 11 wherein said flexible cover is canvas and said decorative image is a Giclee print resembling an oil painting.

13. The apparatus of claim 1 further comprising a guide channel disposed along at least a first side of said opening, and positioned to constrain the movement of said second roller along said direction of traverse.

14. The apparatus of claim 1 further comprising a magnetic strip fixed relative to said frame and aligned along a side of said opening that is parallel to said direction of traverse of said second roller, and wherein said flexible cover has a ferrite coating applied along an edge oriented parallel to said direction of traverse of said second roller such that said ferrite coating magnetically couples to said magnetic strip as said flexible covering unfurls to conceal said opening.

15. A decorative covering for a wall mounted flat screen television, comprising:

a frame with an opening;

a decorative frame removably attached to said frame, said decorative frame having a smaller window opening than said opening in said frame;

a wall mount structure coupled to support said frame adjacent to the wall, said wall mount structure adjustable about a vertical and horizontal axis, thereby enabling alignment of said window opening in said decorative frame with the television;

a decorative side panel disposed about the periphery of said frame between said decorative frame and the wall;

a first roller coupled to said frame, and rotatable about an axis;

a flexible canvas cover, having a decorative image disposed thereon, arranged to loop between a first edge fixed relative to said frame and a second edge affixed to said first roller;

a second roller disposed at the apex of the loop in said flexible canvas cover;

a motor disposed within said first roller and coupled to rotate said first roller in a first direction and a second direction, thereby furling and unfurling said flexible cover to reveal and conceal said opening, and cause said second roller to traverse said opening in a direction substantially perpendicular to said axis;

a guide channel disposed along at least a first side of said opening, and positioned to constrain the movement of said second roller along said direction of traverse;

a remote control receiver operable to receive a radio control signal, and coupled to control said motor to rotate in said first direction and said second direction.

16. A method of revealing and concealing an opening in a frame with a flexible cover, comprising the steps of:

rotating a first roller about an axis in a first direction and a second direction to furl and unfurl the flexible cover, which is arranged to loop between a first edge fixed relative to the frame and a second edge coupled to said roller;

traversing a second roller across the opening in a direction substantially perpendicular to the axis by disposing the second roller at the apex of the loop in the flexible cover, and attaching a decorative frame to the frame, the decorative frame having a smaller window opening than the opening in the frame.

17. The method of claim 16 wherein the decorative frame is removably attached to the frame.

18. The method of claim 16 further comprising the steps of concealing and revealing a wall mounted objected located behind the opening by mounting the frame to the wall using a wall mount structure.

19. The method of claim 18 further comprising the step of disposing a decorative side panel about the periphery of the frame.

20. The method of claim 18 further comprising the step of adjusting the position of the frame about a three orthogonal axis to align the frame with the wall mounted object.

21. The method of claim 20 wherein the wall mounted object is a flat panel television.

22. The method of claim 16 further comprising the step of driving the first roller with a motor.

23. The method of claim 16 further comprising the steps of receiving a remote control signal by a remote control receiver and driving a motor to rotate the first roller according to the received control signal.

24. The method of claim 23 wherein the remote control signal is a radio signal.

25. The method of claim 23 wherein the remote control signal is an infrared signal.

26. The method of claim 16 further comprising the step of disposing a decorative image on a first side of the decorative cover, aligned to be visible when the flexible cover is unfurled to conceal the opening.

27. The method of claim 26 wherein the flexible cover is canvas or synthetic canvas blend and the decorative image is a Giclee print resembling an oil painting.

28. The method of claim 16 further comprising the step of constraining the movement of the second roller along the traversing directions by disposing a guide channel disposed along at least a first side of the opening.

29. The method of claim 16 further comprising the steps of fixing a magnetic strip relative to the frame that is aligned along a side of the opening that is parallel to the traversing direction of the said second roller;

applying a ferrite coating to the flexible cover along an edge oriented parallel to the traversing direction of the second roller, and magnetically coupling the ferrite coating to the magnetic strip as the flexible covering unfurls to conceal the opening.

* * * * *